US008739883B2

(12) United States Patent
Aarnes et al.

(10) Patent No.: US 8,739,883 B2
(45) Date of Patent: Jun. 3, 2014

(54) INTERNAL TREE CAP AND ITC RUNNING TOOL

(75) Inventors: Lasse E. Aarnes, Drammen (NO); Andre M. Smith, Lier (NO)

(73) Assignee: Aker Subsea AS, Lysaker (NO)

( * ) Notice: Subject to any disclaimer, the term of this patent is extended or adjusted under 35 U.S.C. 154(b) by 205 days.

(21) Appl. No.: 12/989,722

(22) PCT Filed: Apr. 28, 2009

(86) PCT No.: PCT/NO2009/000163

§ 371 (c)(1),
(2), (4) Date: Nov. 12, 2010

(87) PCT Pub. No.: WO2009/134141

PCT Pub. Date: Nov. 5, 2009

(65) Prior Publication Data

US 2011/0048726 A1 Mar. 3, 2011

(30) Foreign Application Priority Data

Apr. 28, 2008 (NO) ..... 20082010

(51) Int. Cl.
*E21B 7/12* (2006.01)

(52) U.S. Cl.
USPC ..... 166/368; 166/97.1; 166/351; 166/386

(58) Field of Classification Search
USPC ..... 166/75.13, 92.1, 97.1, 368, 356, 360, 166/351
See application file for complete search history.

(56) References Cited

U.S. PATENT DOCUMENTS

| | | | | |
|---|---|---|---|---|
| 2,961,674 | A * | 11/1960 | Hunt | 15/104.31 |
| 3,887,010 | A | 6/1975 | Sizer et al. | |
| 5,061,118 | A * | 10/1991 | Lemperiere | 405/108 |
| 5,107,931 | A * | 4/1992 | Valka et al. | 166/342 |
| 5,542,475 | A * | 8/1996 | Turner et al. | 166/387 |
| 6,494,257 | B2 * | 12/2002 | Bartlett et al. | 166/86.2 |
| 6,520,263 | B2 * | 2/2003 | June | 166/368 |

(Continued)

FOREIGN PATENT DOCUMENTS

| | | |
|---|---|---|
| EP | 0715056 A2 | 6/1996 |
| GB | 2321658 A | 8/1998 |

(Continued)

OTHER PUBLICATIONS

Georgescu, Mihnea, "International Search Report", for PCT/N02009/000163 as mailed Oct. 19, 2009, 6 pages.

*Primary Examiner* — Matthew Buck
*Assistant Examiner* — Aaron Lembo
(74) *Attorney, Agent, or Firm* — Winstead PC

(57) ABSTRACT

Internal tree cap (201) (ITC) adapted to be installed in the bore of a subsea well unit (301) or to an internal tubular element (303) of the same, comprising a locking element (209) for releasably locking the internal tree cap (201) to said subsea well unit (301) or internal tubular element (303). The ITC further comprises a fluid channel (215) extending through a fluid barrier between the lower and upper part of the internal tree cap (201), which fluid channel (215) is blocked by a burst element (217) adapted to break and open for fluid flow through the fluid channel (215) when exposed to a predetermined pressure difference over the burst element (217). The invention also relates to an ITC running tool (101) and a locking mechanism (117) for supporting the ITC in the tool.

6 Claims, 14 Drawing Sheets

(56) References Cited

U.S. PATENT DOCUMENTS

| | | | | |
|---|---|---|---|---|
| 6,736,012 | B1 | 5/2004 | Beall et al. | |
| 6,845,815 | B2 * | 1/2005 | Hergarden et al. | 166/92.1 |
| 7,637,325 | B2 * | 12/2009 | Goonetilleke et al. | 166/368 |
| 2002/0000322 | A1 * | 1/2002 | Bartlett et al. | 166/368 |
| 2002/0088622 | A1 | 7/2002 | Beall et al. | |
| 2003/0111228 | A1 | 6/2003 | Garrett et al. | |
| 2003/0178202 | A1 | 9/2003 | Bartlett et al. | |
| 2004/0216885 | A1 | 11/2004 | Bartlett | |
| 2008/0210435 | A1 * | 9/2008 | Goonetilleke et al. | 166/368 |

FOREIGN PATENT DOCUMENTS

| | | | |
|---|---|---|---|
| GB | 2432172 | A | 5/2007 |
| WO | WO-96/07812 | A1 | 3/1996 |
| WO | WO-99/28593 | A1 | 6/1999 |
| WO | WO-2007/54664 | A1 | 5/2007 |

* cited by examiner

SECTION A-A

SECTION C-C

SECTION D-D

INTERNAL TREE CAP AND ITC RUNNING TOOL

The present invention relates to an internal tree cap and a tool for running the internal tree cap. In addition, the invention relates to methods of using the tree cap and the tool.

BACKGROUND

Due to the two-barrier philosophy for subsea hydrocarbon wells, an upper and a lower plug are conventionally installed in the bore of a subsea X-mas tree or its internal elements, such as the tubing hanger. It is known to replace the upper plug with an internal tree cap, the tree cap having features in addition to just blocking for fluid connection.

Known internal tree caps are installed and retrieved through a marine riser from a surface installation. Thus, such installing or retrieving operations are cumbersome since they require the establishment of the riser from the surface and down to the well tree. Establishing the riser takes time and one needs to use a rig. Rigs are not always easily available and are also expensive to rent on a day-to-day basis.

In addition, in some instances the PTV-line (plug testing valve) can be blocked, making it impossible to test the space between the lower plug and the internal tree cap. With a conventional internal tree cap run inside a riser, one faces difficulties solving such problems accompanying such situations. For instance, retrieval of the internal tree cap can possibly not be done due to the hydrostatic lock formed by the sealed-off space below the internal tree cap.

International patent application publication WO2007054644 describes a cap for a subsea tree and for use with a tubing hanger. This cap is adapted to be arranged both internally and externally about the tree spool, and is not adapted to be landed through a marine riser. It is adapted to be landed on a wire.

Furthermore, patent application publication US20040216885 describes a method for installing a tree cap on a subsea Xmas tree with the use of an ROV. The cap has a channel through it in order to provide a vacuum or negative pressure in the space below the cap, thereby "sucking" the cap into place.

OBJECT

The present invention seeks to solve the above-mentioned problems related to conventional internal tree caps (ITC) and internal tree cap tools (ICT tool). In addition, the present invention provides for some advantageous features still not disclosed in the prior art.

THE INVENTION

According to a first aspect of the invention, there is provided an internal tree cap (ITC) which is adapted to be installed in the bore of a subsea well unit or to an internal tubular element of the same. The ITC comprises a locking element for releasably locking the ITC to said subsea well unit or internal tubular element. The ITC further comprises a fluid channel extending through a fluid barrier between the lower and upper part of the internal tree cap, which fluid channel is blocked by a burst element which is adapted to break and open for fluid flow through the fluid channel when exposed to a predetermined pressure difference over the burst element. With such an ITC, fluid access to the space below an installed ITC can be provided without the use of an ROV, even if the PTV line (pressure testing valve) is blocked. This will be further described below.

Preferably the ITC according to the first aspect of the invention comprises a valve arranged in connection with a fluid passage in said fluid barrier between the upper and lower part of the tree cap. When access to the ITC is not prevented, for instance by a marine riser, an ROV can open the valve in order to provide fluid connection to the space below the ITC.

A pipe can be arranged with fluid connection to the top of said fluid channel and can advantageously be provided with a bend or a filter in order to prevent falling debris to block the fluid channel.

The ITC can preferably comprise an outer sleeve reciprocally arranged on an inner sleeve, which outer sleeve is adapted to force a locking split ring outwardly into engagement with a subsea well element or an internal tubular element thereof, when being forced downwards in relation to the inner sleeve. This way, the ITC is adapted to be run by an ITC running tool, such as the one described further below.

The subsea well unit can be a tree spool and said internal tubular element can be a tubing hanger arranged in the tree spool.

Preferably, the upper part of the ITC is adapted to be arranged flush with or lower than the upper part of the subsea well unit, such as a tree spool, into which it is arranged.

The ITC can have a hotstab receptacle for an ROV hotstab, with fluid connection to the space below the internal tree cap, enabling pressure test of said space by means of an ROV when installed.

According to a second aspect of the present invention, there is provided a method of retrieving an internal tree cap through a marine riser, from the bore of a subsea well element, wherein a PTV-line (plug testing valve-line) is blocked, which blocking has resulted in a sealed off space between the internal tree cap and a lower barrier, such as a lower plug. The method comprises the following steps:

a) connecting an internal tree cap retrieving tool to the internal tree cap;
b) applying pressure in the riser of such magnitude that a burst element in a fluid channel between said space and the upper side of the internal tree cap bursts, thereby opening said channel; and
c) pulling up said retrieving tool, thereby disengaging the internal tree cap from engagement with the subsea well unit.

According to a third aspect of the present invention, there is provided a tool for locking an internal tree cap (ITC) to the bore of a subsea well unit or retrieving it from the same, the tool being adapted to lock onto the subsea well unit, directly or indirectly. The tool comprises a wire connection member for wire suspension of the tool from a surface installation and actuation means for locking said internal tree cap directly or indirectly in the bore of the subsea well unit, and ITC support means for supporting the internal tree cap. The tool is adapted to be retrieved from said subsea well unit and internal tree cap when installed, as said ITC support means is adapted to release the ITC from the tool, preferably by actuation with an ROV.

The tool is preferably adapted to move the ITC in a vertical direction to a landed position, and further force an ITC-member vertically downwards to an ITC locked position. Furthermore, the tool preferably comprises an indication means for indication of the unlanded, landed and the locked position, wherein said indication means being visible from the exterior of the tool.

In one embodiment the tool can be latched and unlatched to the ITC with a latching handle, and said latching handle can be locked in a latched position by means of a locking pin, preventing unintentional unlatching of the ITC from the tool.

Preferably, the tool is adapted to releasably connect to an outer sleeve of the internal tree cap, and, after landing of the internal tree cap, force said outer sleeve downward by actuating at least one ROV-actuated hydraulic piston, in order to lock the internal tree cap to a tubing hanger in said bore.

In one embodiment of the tool, the ITC support means comprises a

- a main body with a plurality of locking members arranged along an outer perimeter of the main body, the locking members being rotatable supported on the main body about respective rotation axes;
- an actuation ring arranged within an inner perimeter of the main body, said actuation ring comprising a plurality of engagement elements which extend into engagement slots of the locking members, so as to rotate the locking members about said axes by rotation of the actuation ring with respect to the main body;
- wherein the locking members according to their rotational position are adapted to assume a locking position, wherein their perimeter extends a first distance out from the ITC support means and an unlocked position
- wherein said distance is shorter than the first distance, as the distance from the axes of the locking members to their perimeter varies along the perimeter.

Preferably, the ITC support means can be operated by an ROV through an ITC latching handle extending on the exterior of the tool.

According to a fourth aspect of the present invention, there is provided a method for installing an internal tree cap in the bore of a subsea well unit through a marine riser from a surface installation. The method comprises the following steps:

a) lowering a running tool down to the subsea well unit through said riser, the running tool carrying an internal tree cap, until the internal tree cap has landed in the bore of said subsea well unit;

b) dropping a ball down through said riser, thereby closing a channel in said running tool;

c) applying pressure in the bore of said riser, thereby providing for downward movement of a hydraulic piston that forces an outer sleeve of the internal tree cap to move downward, which further results in forcing a split ring of the internal tree cap into engagement with the bore or bore profile of the subsea well unit or an internal tubular member thereof.

Such a method for installation makes it possible to install the ITC according to the first aspect of the invention also through a marine riser. Thus, the ITC is not restricted to use with a wire-suspended running tool According to a fifth aspect of the invention, there is also provided a method of retrieving an internal tree cap through a marine riser, from the bore of a subsea well element, wherein the PTV-line (plug testing valve-line) is blocked, wherein the blocking has resulted in a sealed off space between the internal tree cap and a lower plug. The method comprises the following steps:

a) connecting an internal tree cap retrieving tool to the internal tree cap;

b) applying pressure in the riser of such magnitude that a burst element in a fluid channel between said space and the upper side of the internal tree cap bursts, thereby opening said channel; and c) pulling up said retrieving tool, thereby disengaging the internal tree cap from engagement with the subsea well unit.

According to a sixth aspect of the invention, there is provided a locking mechanism for locking to internal or external locking grooves of a circular bore or member, respectively. The locking mechanism comprises

- a main body with a plurality of locking members arranged along an inner or outer perimeter of the main body, the locking members being rotatable supported on the main body about respective rotation axes;
- an actuation ring arranged within the inner perimeter of the main body or outside its outer perimeter, respectively, said actuation ring comprising a plurality of engagement elements which extend into engagement slots of the locking members, or vice versa, so as to rotate the locking members about said axes by rotation of the actuation ring with respect to the main body;
- wherein the locking members according to their rotational position are adapted to assume a locking position, wherein their perimeter extends a first distance radially out from the locking mechanism or radially inwardly from the locking mechanism, respectively, and an unlocked position, wherein said distance is shorter than the first distance or non-existent, as the distance from the axes of the locking members to their perimeter varies along the perimeter.

Such a locking mechanism is suitable for locking a member to the internal grooves in a bore, such as the internal grooves of a tree spool or an internal tree cap, such as the one illustrated herein. The locking mechanism can also be arranged to lock to external grooves of a circular member, such as externally onto a tree spool. The mechanism is actuated by rotation of the actuation ring with respect to the main body. Thus, the main body could also be rotated to obtain the same function. It is understood that the locking mechanism can lock onto concentric shapes as well as non-concentric shapes, such as a locking groove with the cross section of an elliptical circle.

The locking members can have the shape of plates. This will have advantage over other solutions as locking pins or expandable split rings, by being able to adsorb larger forces and by avoiding altering the shape (such as a split ring).

The plates can preferably be arranged between two surfaces, of which one is the surface of the main body. Thus, the plates can preferably be supported with bolts running from one of the surfaces to the other, through said plates.

Instead of arranging engagement slots in the locking members, the locking members could also be provided with engagement members, such as protrusions extending into engagement slots in the actuation ring.

As will readily be appreciated by the person skilled in the art, the present invention exhibits a plurality of advantages.

The ITC tool gives the possibility of running an ITC without the use of a marine riser. It is comparably cost-efficient and easy to use.

The ITC can be run both by the tool according to the first aspect of the invention, and through a marine riser. In addition it exhibits preferable features giving a plurality of advantages and possibilities.

Having described the main features of the present invention, a more detailed description of an example embodiment will be given in the following.

EXAMPLE OF EMBODIMENT

In the following, a description of an example embodiment of an internal tree cap (ITC) and an ITC tool according to the invention will be given with reference to the drawings, in which FIGS. 1A and 1B are perspective views of an ITC running tool according to the present invention;

Figure 1A:
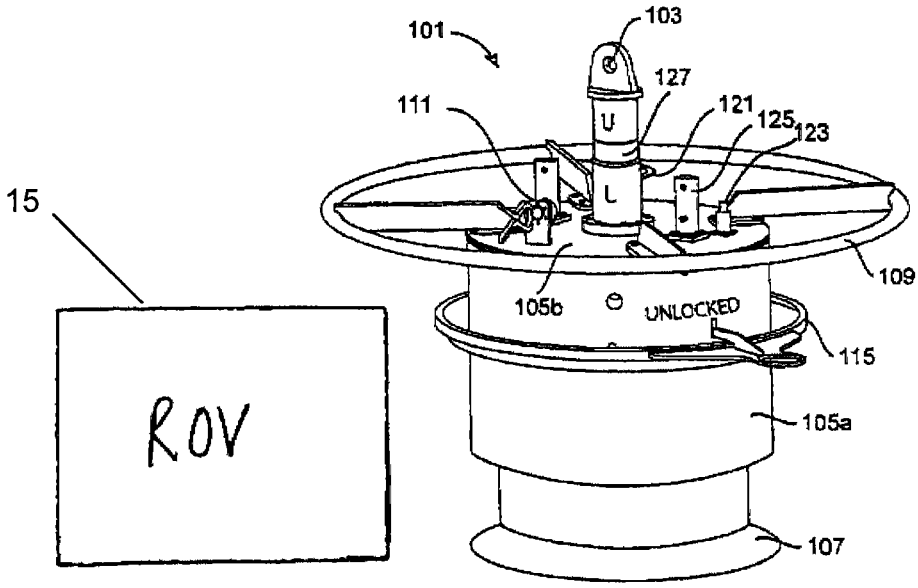
Figure 1B:
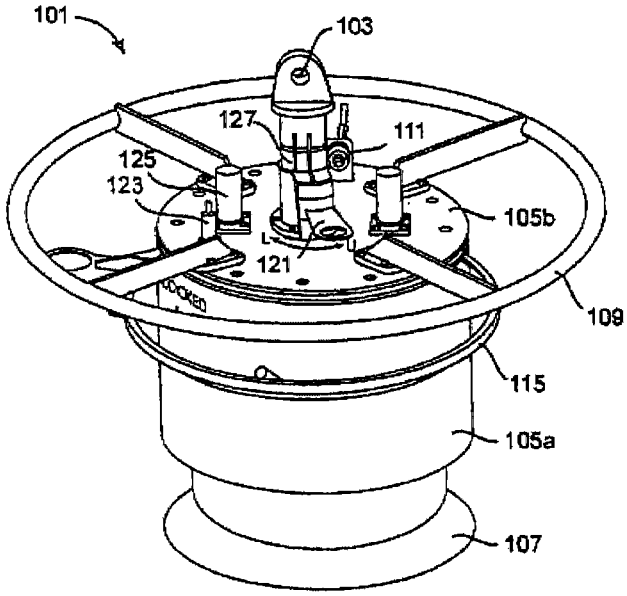

In FIGS. 1A and 1B, an internal tree cap running tool 101 according to the first aspect of the present invention is illustrated. Actually, the ITC tool 101 is a rebuilt light tree running tool. The ITC tool 101 is adapted to be suspended on a wire (not shown) over a suspension bracket with an eye 103 on top of the tool 101. It is thus adapted to be landed on a tree spool (not shown) by means of a winch and an ROV. The tool has a cylindrical housing part 105*a* and a top housing part 105*b*. Under the housing 105 is arranged a funnel 107, ensuring gentle contact between the tool 101 and a tree spool (not shown) when landing the tool 101 onto the spool. Connected to the top housing 105*b* is a circular handling bar 109 for protection of the tool 101 and for handling by an ROV (remotely operated vehicle) (not shown). Also shown in FIGS. 1A and 1B is an ROV hotstab receptacle 111 for receiving an ROV hotstab. The function of this will be explained further below, as will other elements shown in FIGS. 1A and 1B.

Figure 2:
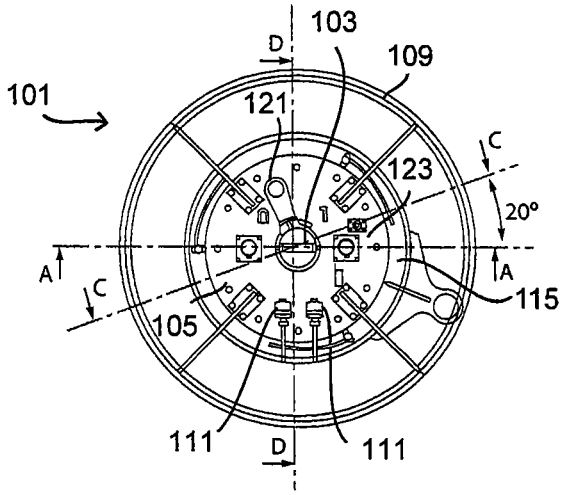
FIG. 2 is a top view of the ITC running tool in FIGS. 1A and 1B.

FIG. 2 shows the ITC tool from above. Here one can see two ROV hotstab receptacles 111, the handling bar 109, the top housing 105*b*, and the suspension bracket with the eye 103. The main purpose of FIG. 2 is to indicate the cross sections of the following FIGS. 3, 4 and 5.

Figure 3:
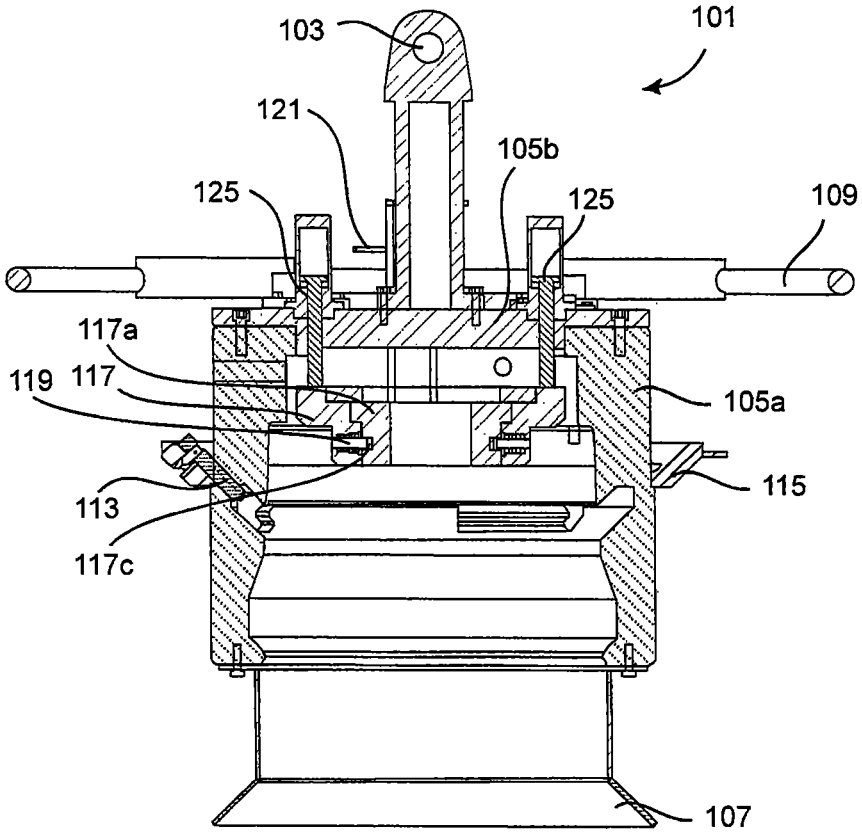
FIG. 3 is a cross section view of the tool in FIG. 2, along section A-A.
Figure 9:
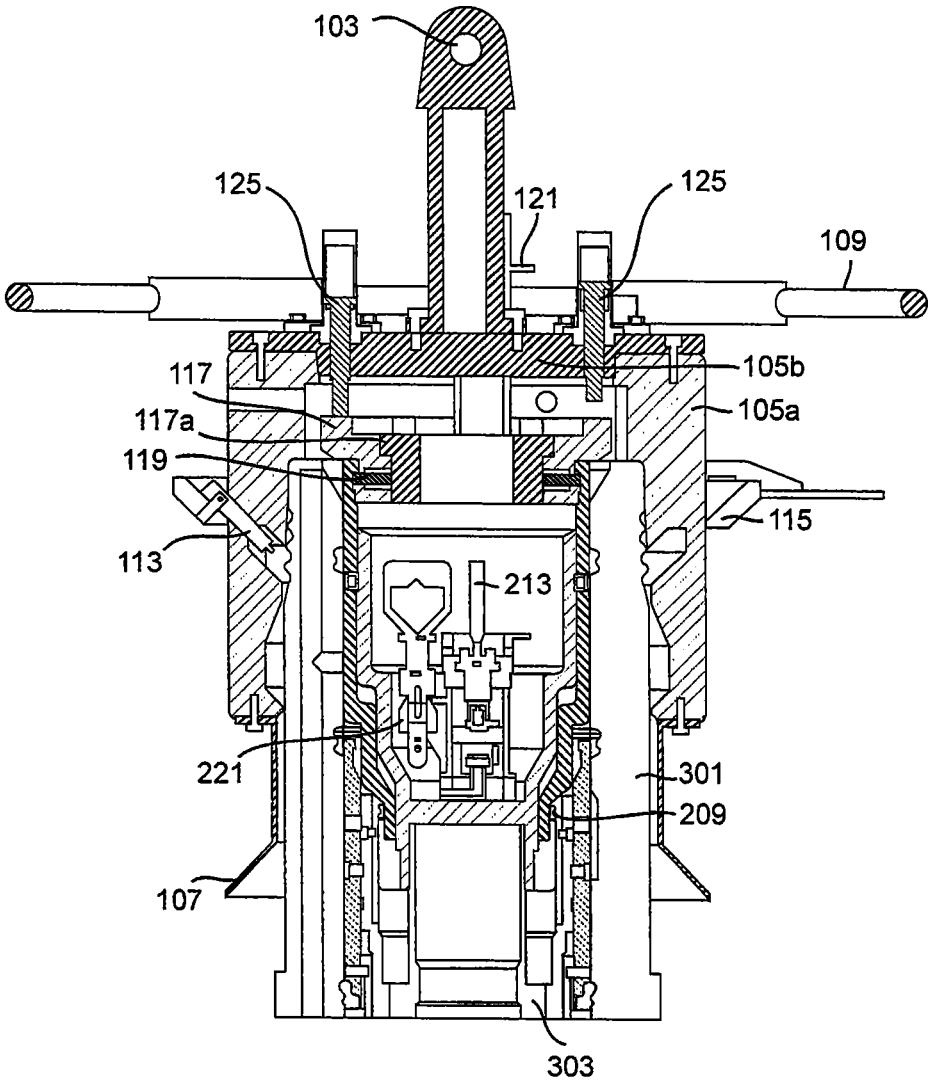
FIG. 9 is a cross section view of the tool landed on a tree spool, during running of the ITC.

FIG. 3 shows a cross section view of the ITC tool 101 through section A-A. In this drawing, a latching element 113 is shown supported in the housing 105*a*. The latching element 113 is adapted to move into or out of engagement with an outer groove of the tree spool (see FIG. 9). To provide this movement, the latching element 113 is operatively connected to an actuation ring 115 which can be operated by an ROV (not shown). In this manner, the ITC tool 101 can be latched to or unlatched from a tree spool. FIG. 9 shows the tool 101 landed on a tree spool.

Also shown in FIG. 3 is an ITC holding element 117. The holding element 117 is adapted to hold the ITC by means of a plurality of holding pins 119 which are adapted to extend into a mating groove in the outer part of the ITC. In FIG. 3, the holding pins 119 are shown in a non-holding retracted position. The holding pins 119 are biased towards this position by means of springs. When in this position, their inner ends extend into mating grooves 117*c* in a rotating inner part 117*a* of the ITC holding element 117. The said grooves have inclined faces that determine the radial position of the holding pins 119 according the angular position of the rotating inner part 117*a*. The rotating inner part 117*a* can be rotated from the outside of the ITC tool 101. This is performed by rotating an ITC latching handle 121 with an ROV. Thus, after proper installation of the ITC, the ITC can be detached from the running tool 101.

The process of locking the ITC to the tubing hanger takes place by activation of two hydraulic pistons 125. Hydraulic pressure can be supplied to their upper hydraulic chamber through one of the hotstab receptacles 111, by means of an ROV. This pressure will force the ITC holding element 117 downwards, providing a secure connection between the ITC and the tubing hanger. This process step will be described further below (see especially FIG. 9).

Figure 4:
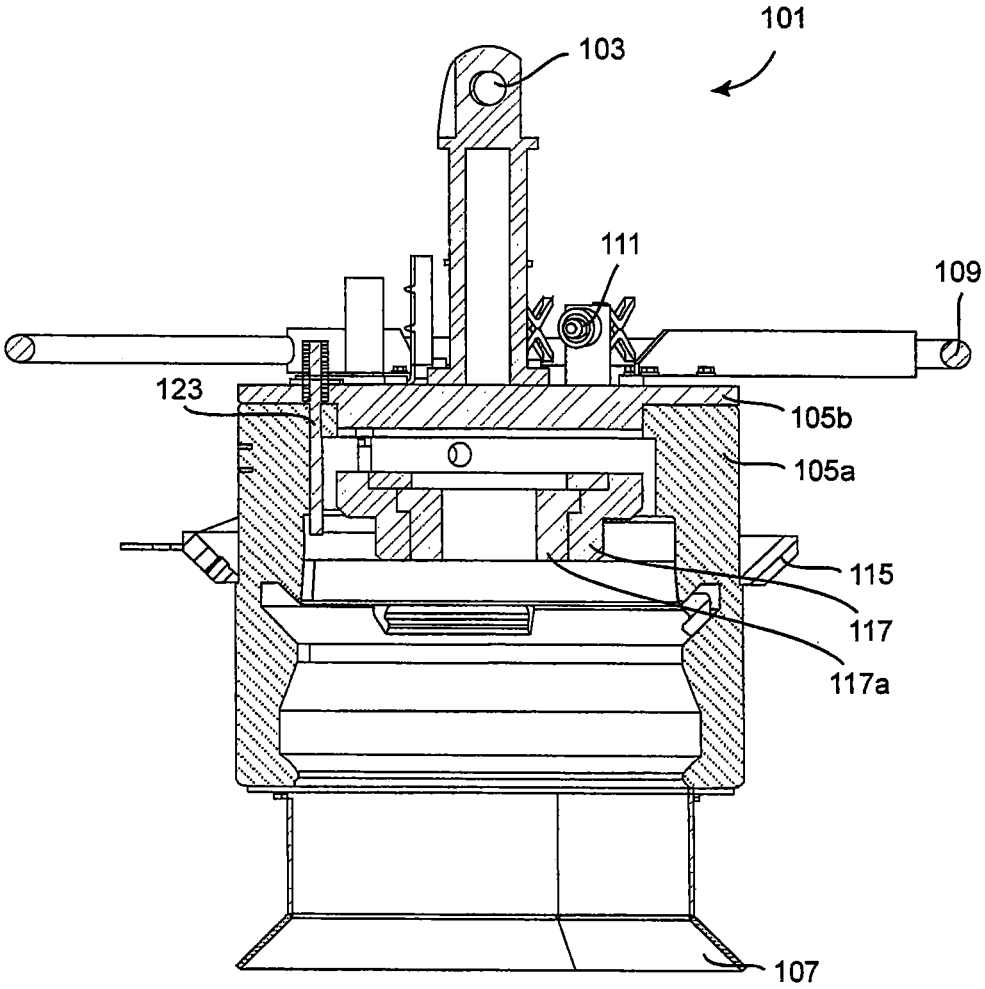
FIG. 4 is a cross section view of the tool in FIG. 2, along section C-C.

FIG. 4 illustrates the section C-C of the tool in FIG. 2, showing most of the elements shown in the cross section view of FIG. 3. In addition, FIG. 4 shows one of the hotstab receptacles 111, which is attached to the top housing 105*b*. Also shown in FIG. 4 is a tool landing indicator pin 123. The indicator pin 123 is biased downwards by means of a spring. When the ITC tool 101 is landed on top of a tree spool (FIG. 9), the indicator pin 123 will come into contact with the upper part of the tree spool, resulting in an upward movement of the pin 123 with respect to the rest of the tool 101. When the tool 101 is fully landed on the tree spool, the tool landing indicator pin 123 will extend a predetermined length above the top housing 105*b*. In this manner, the operator will know when the tool 101 is fully landed, by inspecting the position of the pin 123, for instance by means of an ROV camera.

Figure 5:
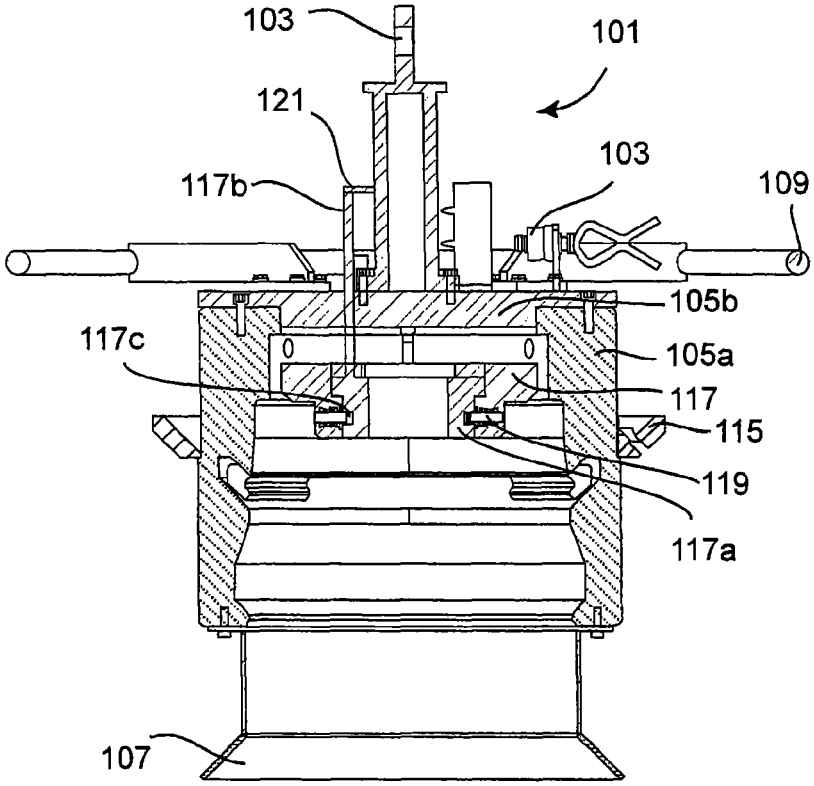
FIG. 5 is a cross section view of the tool in FIG. 2, along section D-D.

FIG. 5 is an additional view of the ITC tool 101 in FIG. 2, showing the cross section D-D. Here, a extension part 117*b* of the rotating inner part 117*a* can be seen extending upwards through the top housing 105*b* and connected to the ROV-operable ITC latching handle 121.

Having described the main features of an ITC running tool 101 according to the first aspect of the present invention, an internal tree cap 201 according to the second aspect of the invention will now be described.

Figure 6:
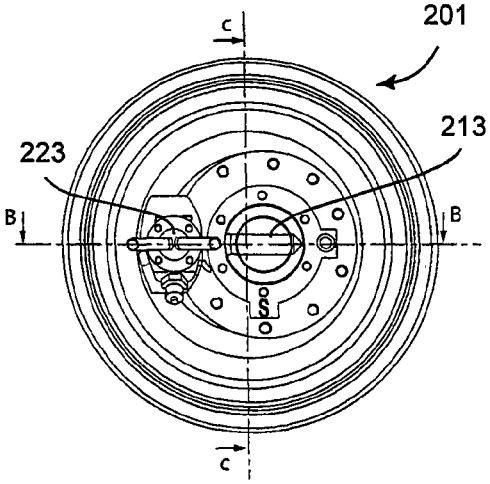
FIG. 6 is a top view of an internal tree cap (ITC) according to the present invention.

FIG. 6 is a top view of an internal tree cap 201 according to the second aspect of the present invention. In FIG. 6, the cross sections of FIGS. 7A and 7B are indicated as B-B and C-C, respectively.

Figure 7B:
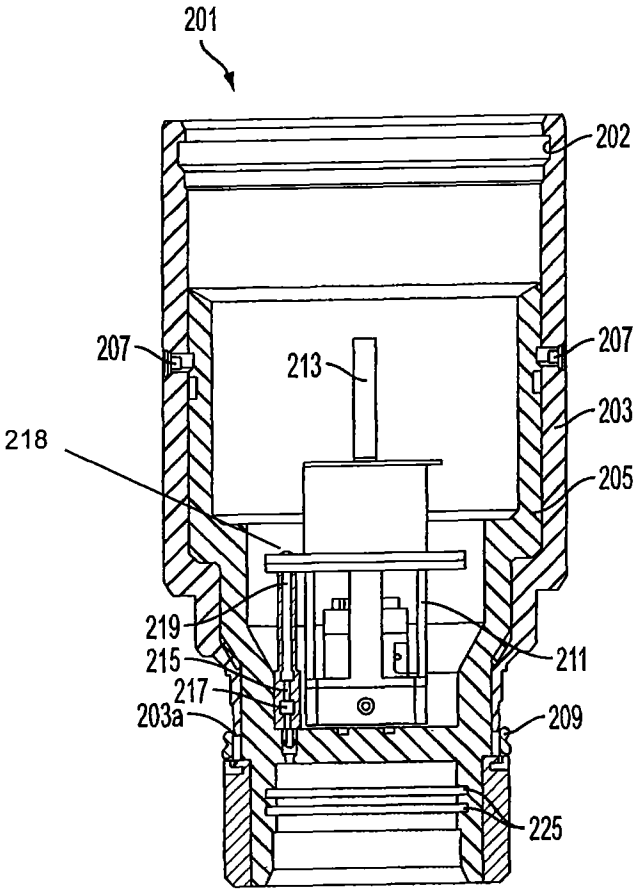
FIGS. 7A and 7B are cross section views of the ITC in FIG. 6, along the surfaces B-B and C-C, respectively.
Figure 7A:
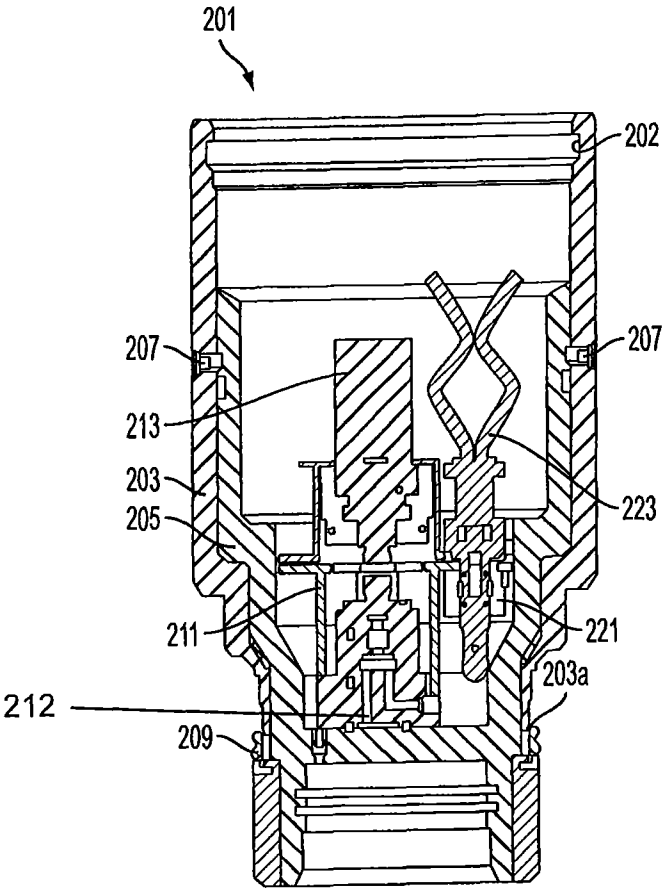
Figure 8:
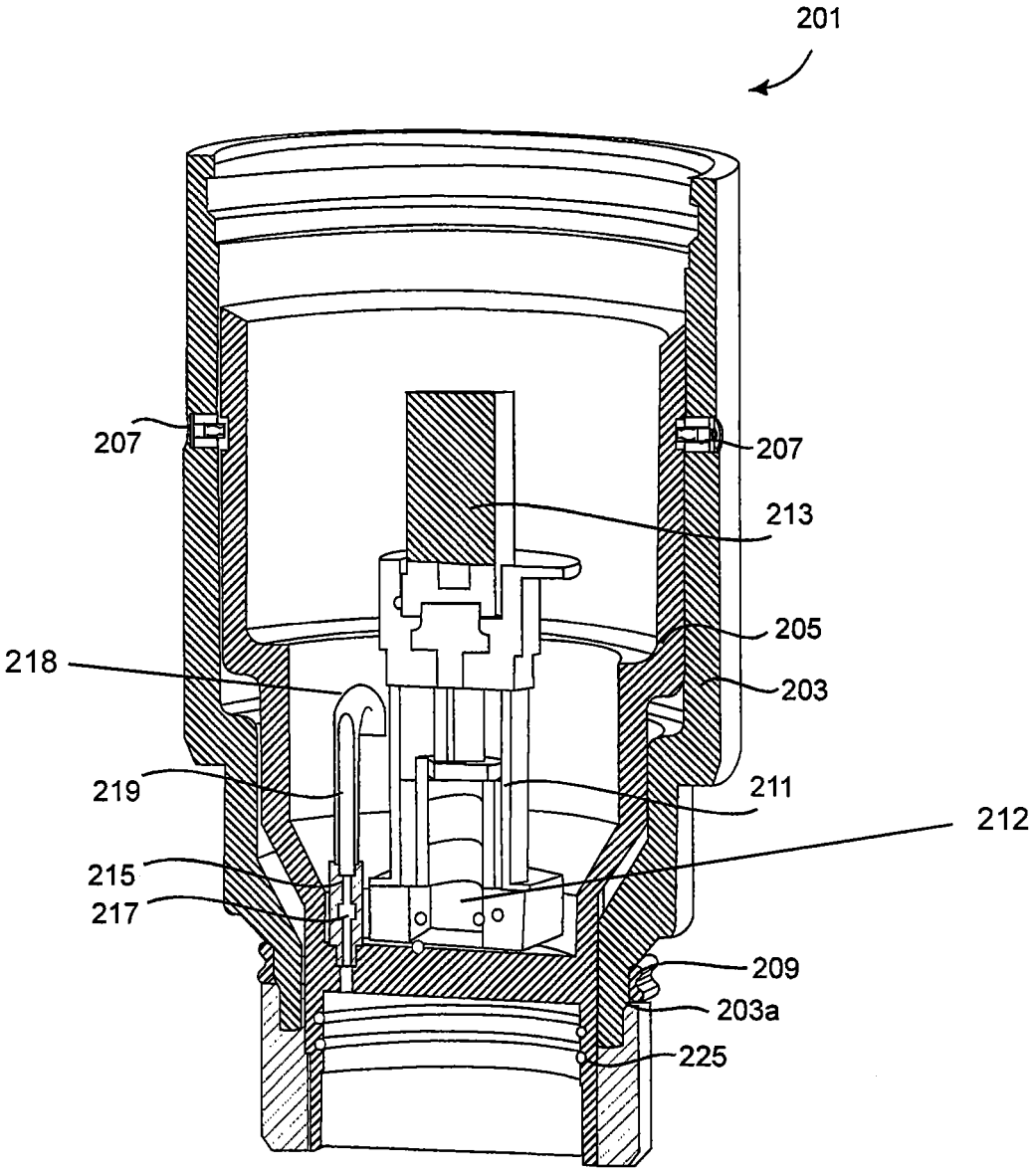
FIG. 8 is a perspective cross section view of the ITC in FIG. 6.

FIG. 7A depicts the cross section B-B of the ITC 201 in FIG. 6. The ITC 201 has an outer sleeve 203 which is reciprocally connected to an inner sleeve 205. The outer sleeve 203 can slide on the inner sleeve 2005 between an upper and lower position. In FIG. 7A (and FIG. 7B) the outer sleeve 203 is shown in the upper position. A plurality of shear pins 207 extend from the outer sleeve 203 into recesses in the inner sleeve 205, and are inwardly biased by means of springs. When sliding downwards to the lower position, the shear pins 207 will slide on an inclined face, forcing the pins 207 radially outward, until they snap into a neighbouring lower recess, securing the outer sleeve 203 in the lower position. This position is illustrated in FIG. 8.

The outer sleeve 203 is provided with an inner locking groove 202, adapted to receive holding pins 119 of the running tool 101, or corresponding locking elements.

Referring to FIGS. 7A and 7B, below the outer sleeve 203 is arranged an ITC locking element in the form of a split ring 209. The split ring 209 is adapted to expand radially and lock to an inner profile of a tubing hanger (see FIG. 9). In order to expand the split ring 209, the outer sleeve 203 is forced downwards, making an inclined face 203*a* of the outer sleeve 203 force the split ring 209 radially outwards. The downward movement of the outer sleeve 203 is provided by actuating the pistons 125 of the ITC tool 101. This makes the holding element 117 force the outer sleeve 203 downwards. When the outer sleeve 203 has moved down to its lower position, it is held in place by means of the shear pins 207, as explained above (FIG. 8). For the operator to know the position of the pistons 125, a locking indicator 127 (see FIGS. 1A and 1B) is operatively connected to the ITC holding element 117. The locking indicator 127 thus moves vertically along with the pistons 125, indicating the position of the outer sleeve 203 of the ITC 201.

For sealing engagement with the tubing hanger, the ITC 201 is provided with a pair of seals 225.

In FIG. 9, the ITC 201 is shown connected to the ITC tool 101, wherein the tool 101 has landed on the tree spool 301 and the ITC 201 has been landed and connected to the tubing hanger 303. The outer sleeve 203 of the ITC 201 is thus in its lower position, and the split ring 209 is engaged with the inner profile of the tubing hanger 303. After a successful pressure test, the ITC tool 101 can be retrieved. The tool 101 is disconnected from the ITC 201 as explained above, by turning the rotating inner part 117*a*, thereby retracting the holding pins 119 from engagement with the ITC 201.

For retrieving the ITC 201 from the tubing hanger 303 with the ITC tool 101, the tool is lowered down onto the ITC 201. In this position, the holding pins 119 are in the retracted position. By rotating the rotating inner part 117*a* of the holding element 117, inclined faces (not shown) of the rotating inner part 117*a* will force the holding pins 119 into the facing grooves of the outer sleeve 203. As the ITC holding element 117 now is secured to the outer sleeve 203, actuation of the pistons 125 by means of an ROV will force the outer sleeve 203 upwards, and release the split ring 209 of the ITC 201 from engagement with the tubing hanger 303. The ITC 201 can now be retrieved by unlocking the tool 101 from the tree spool 301 and pulling it up by the wire (not shown). This process is substantially the opposite of installing the ITC 201, as explained above.

Figure 10:
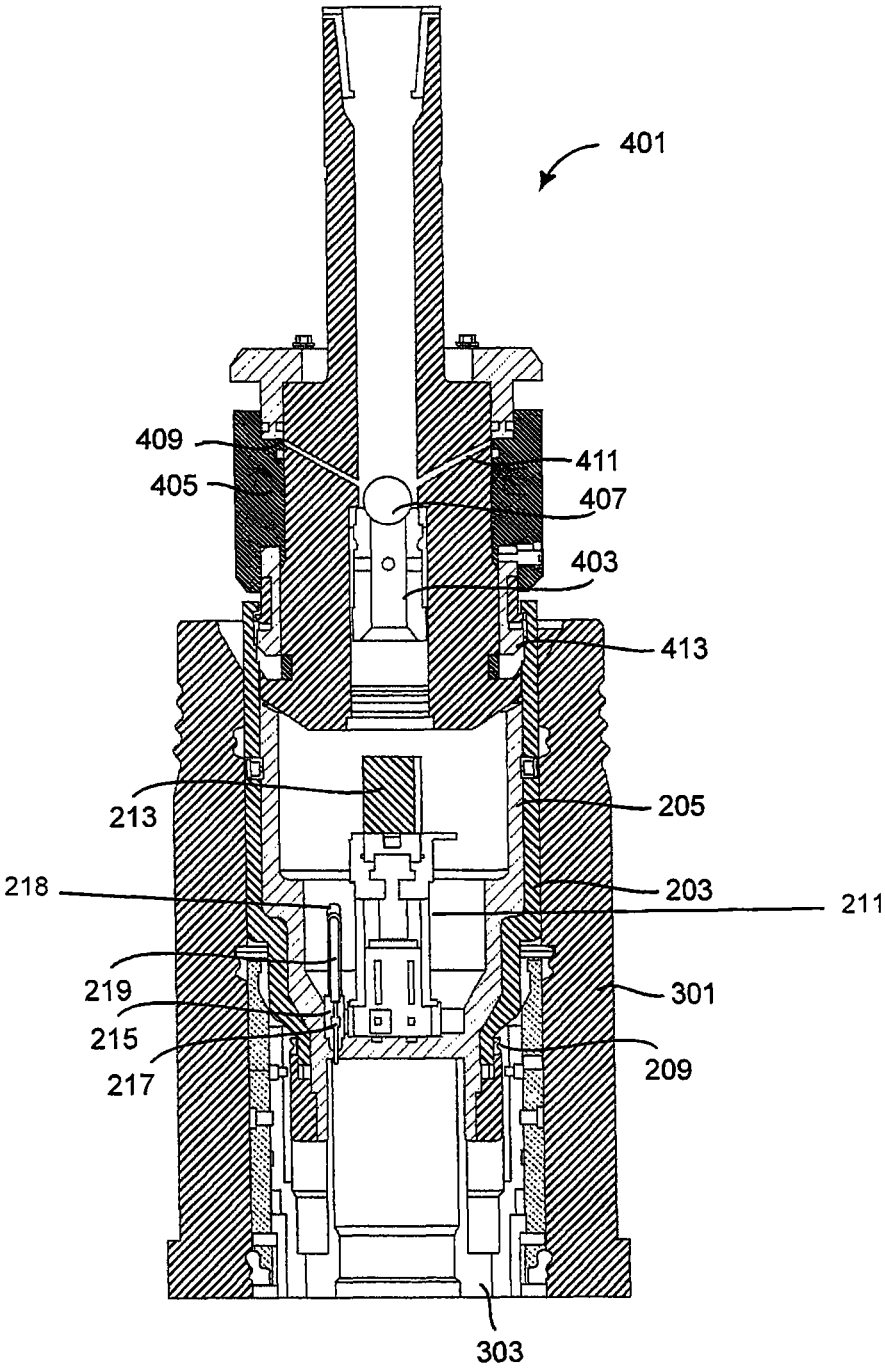
FIG. 10 is a cross section view of an ITC being installed on a tubing hanger with a BPRT (borehole protector running tool) through a marine riser.
Figure 11:
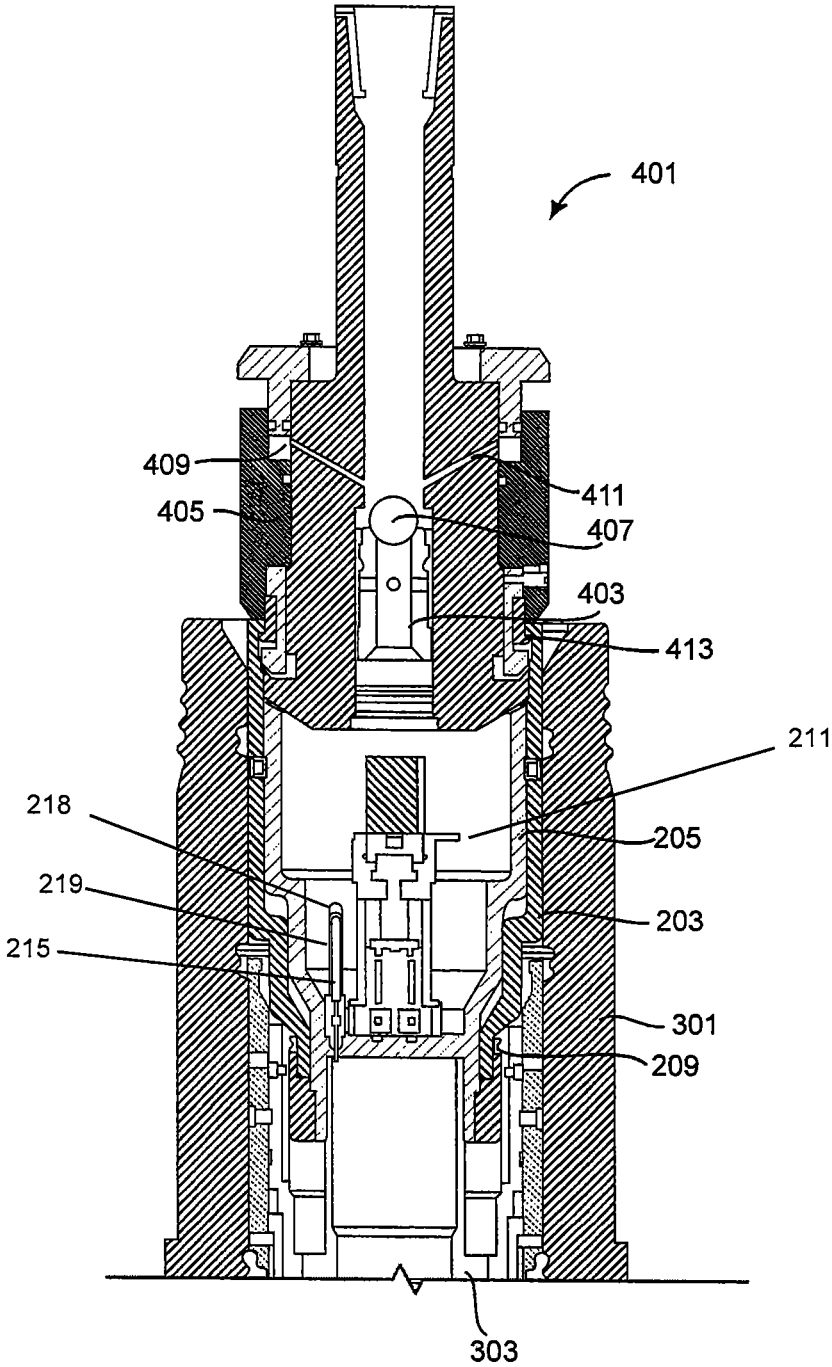
FIG. 11 is a cross section view of the ITC in FIG. 10, having been locked to the tubing hanger.

The ITC 201 according to the second aspect of the present invention can also be run on a bore protector running tool 401 (BPRT) through a marine riser (not shown), as illustrated in FIGS. 10 and 11. In FIG. 10, the ITC 201 has been landed on the tubing hanger 303 inside the tree spool 301. Inside the BPRT 401, there is a channel 403 for letting fluid flow freely in and out of the BPRT bore. The ITC 201 is now to be secured to the tubing hanger 303 by moving down the outer sleeve 203 to its lower position. This is done by moving a hydraulic piston 405 downwards onto the outer sleeve 203 by applying hydraulic pressure through the marine riser (not shown). To do this, the channel 403 is first closed off by dropping a ball 407 down through the riser and sealingly cover the opening of the channel 403. Pressure in the marine riser is then applied, which will provide for pressure in the hydraulic chamber 409 above the piston 405. The pressure is transferred through the hydraulic channels 411.

The resulting movement of the hydraulic piston 405 will move the outer sleeve 203 of the ITC 201 downwards, as illustrated in FIG. 11. In the same manner as explained above, the outer sleeve 203 will force the split ring 209 into locking engagement with the tubing hanger 303.

To retrieve the BPRT 401, it must now be disconnected from the ITC 201. This takes place by a further downwardly movement of the hydraulic piston 405. This movement will result in a retraction of a split ring 413 that until this movement was in engagement with an internal groove of the ITC 201.

To retrieve the ITC 201 with the bore protector running tool 401 (BPRT) through the marine riser, the BPRT 401 lowered against the ITC 201 with the split ring 413 in extended position. When contacting the upper part of the outer sleeve 203 of the ITC 201, the split ring 413 will be forced radially inward. When moving the BPRT 401 even further down, the split ring 413 will snap into the facing groove in the upper part of the outer sleeve 203, thereby constituting a secure engagement with the ITC 201. Pulling the BPRT 401 back up will detach the ITC 201 from the tubing hanger, and the ITC 201 can be retrieved through the marine riser (not shown).

Referring again to FIG. 8 (as well as FIGS. 7A and 7B), the ITC 201 exhibits a disc valve 211 for opening or closing a fluid passage 212 between the lower and upper part of the ITC 201. The disc valve 211 exhibits a large handling flange 213 for interfacing with an ROV 15 (see, FIG. 1). Thus, an ROV can open and close the disc valve 211 from above.

The ITC 201 according to this example embodiment also exhibits a fluid channel 215 in addition to the disc valve 211, extending between the upper and lower part of the ITC 201. Inside the fluid channel 215 is arranged a burst element in form of a burst disc 217 which is adapted to break at a predetermined pressure difference between the upper and lower part of the ITC 201. This feature is advantageous if the ITC 201 is to be retrieved through a marine riser and the PTV-line (plug testing valve) (not shown) is blocked by debris. The PTV-line is normally used for pressure testing between the lower and upper plug, or lower plug and the ITC. However, if the PTV-line is blocked, and the disc valve 211 is closed, the ITC 201 cannot be retrieved due to hydrostatic locking of the ITC 201. This problem is solved by applying enough pressure in the riser, above the ITC 201, so that the burst disc 217 breaks. This provides venting of the space below the ITC 201, so that it can be retrieved through the riser.

In connection with and above the fluid channel 215 there is a pipe 219 with a 180 degree bend 218, which protects the fluid channel 215 from being blocked by falling debris.

Referring again to FIG. 7A, the ITC 201 also exhibits an ROV hotstab receptacle 221. In FIG. 7A, a hot stab dummy 223 is arranged in the receptacle 221. Through the receptacle 221, an ROV can perform pressure test of the ITC 201 from below, by applying pressure through the receptacle 221 and through fluid passage 212, via valve 211, into the space below the ITC 201. Thus, if the PTV-line is blocked by debris, a pressure test can still be performed by the ROV.

Figure 12:
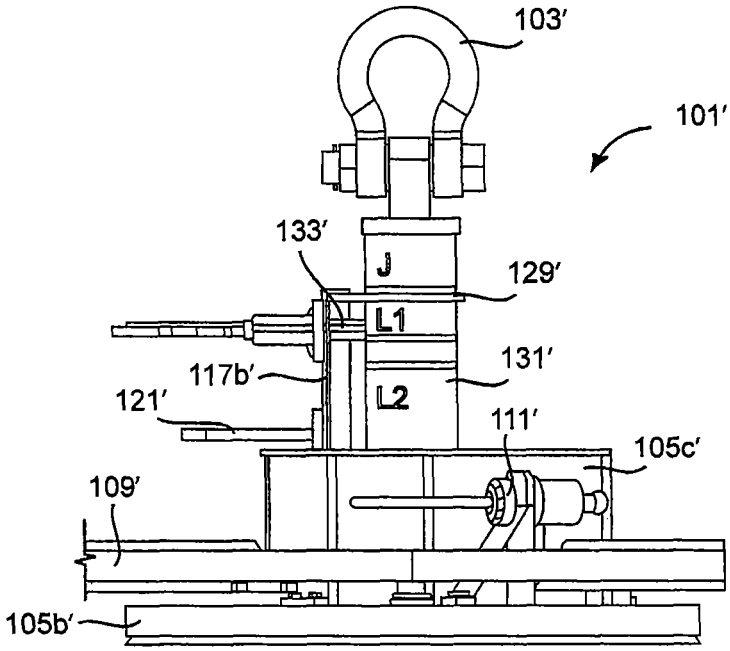
FIG. 12 is a cross section view of the top part of an ITC running tool.
Figure 13:
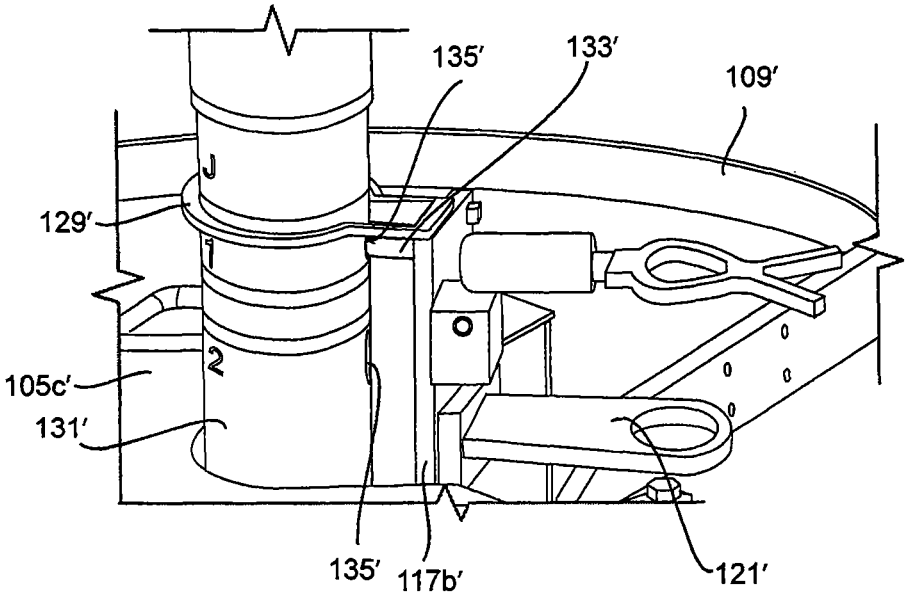
FIG. 13 is an enlarged perspective view of the top part shown in FIG. 12.

In the following, some examples of further embodiments are given. In FIG. 12 and FIG. 13, the top of an ITC running tool 101' is shown in a side view and perspective view, respectively. This running tool 101' is provided with a cover 105*c*' that covers three hydraulic pistons 125' (not visible), as well as hydraulic lines arranged on top of the top housing part 105*b*'. The three hydraulic pistons 125' have the same function as described above (pistons 125), namely to actuate the outer sleeve 203' of an ITC 201' (not shown) in the vertical direction. In order to indicate the vertical position of said outer sleeve 203' of the ITC 201' when connected to the ITC running tool 101', an extension part 117*b*', corresponding to the extension part 117*b* in FIG. 5, extends to a position indication ring 129'. The position indication ring 129' encircles the stem 131' running from the top housing part 105*b*' to the lifting interface 103' at the very top of the tool. On the stem 131' are three position indications, U, L1, and L2, each representing a specific vertical position of the outer sleeve 203' of the ITC 201'. The position U indicates an unlocked position, in which the ITC 201'. The position L1 indicates a landed position, wherein the inner sleeve 205' of the ITC 201' has landed on the tubing hanger 303' (cf. FIG. 9). The position L2 indicates that the outer sleeve 203' has been forced downwards with respect to the inner sleeve 205', in which case the ITC has been locked to the tubing hanger 303'.

In the manner as described above with reference to FIG. 3, the tool 101' can be latched and unlatched from the ITC 201' by rotational operation of a latching handle 121'. In order to avoid unintended rotation of the latching handle 121', the extension part 117*b*' is provided with an ROV-operable locking pin 133' that extends into a bore 135' in the stem 131'. In this embodiment, the stem 131' is provided with two such bores 135', enabling the rotational fixation of the latching handle 121' in the unlocked position U and the locked position L2, as described above, when the tool 101' is locked to the ITC 201'.

Figure 14:
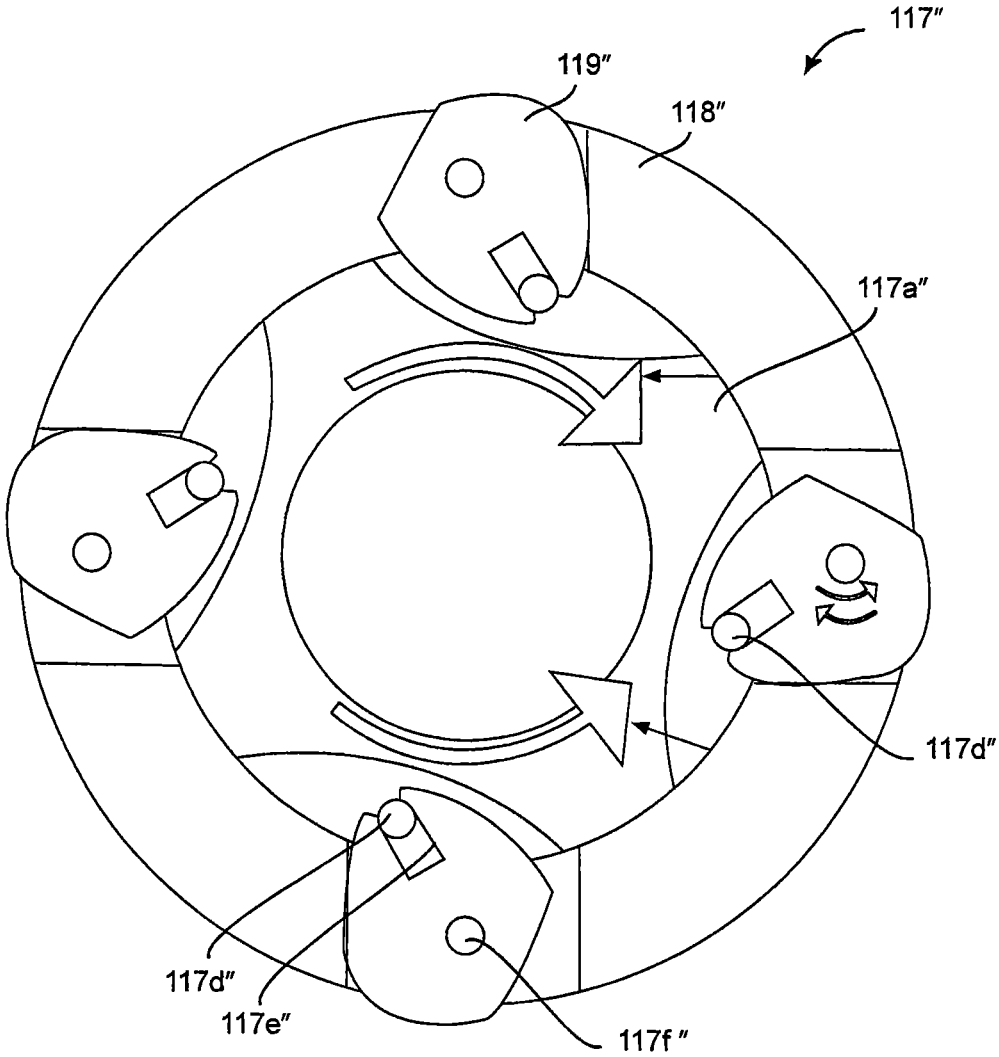
FIG. 14 is a top view of an alternative ITC holding element.

FIG. 14 shows a top view of an embodiment of an ITC running tool 101" with an alternative ITC support means or ITC holding element 117" for latching a running tool 201" to the ITC. The ITC holding element 117" comprises a main body 118" non-rotationally arranged within a cylindrical housing part corresponding to the part 105*a* shown in FIG. 5. Connected to an extension part 117*b*" (FIG. 15) is a rotating inner part 117*a*". The rotating inner part 117*a*" has four guide bolts 117*d*" extending into the slots 117*e*" of four holding plates 119". The holding plates 119" are rotationally arranged to the main body 118" of the ITC holding element 117", attached with rotation bolts 117*f*". Thus, when rotating the rotating inner part 117*a*", the holding plates 119" are rotated since the guide bolts 117*d*" extend into said slots 117*e*". In FIG. 14, the holding plates 119" are shown in a latched position, wherein a part of them extend outside the circular perimeter of the main body 118". In this position, the plates can lock to the ITC by extending into the internal locking grooves of the outer sleeve of an ITC (such as grooves 202 shown in FIGS. 7A and 7B). The rotating inner part 117*a*" can also be rotated to move or rotate the holding plates 119" into a position wherein they are not extending outside the said perimeter. In this position, the ITC running tool will not be latched to the ITC. It should be apparent for a person skilled in the art that the number of holding plates 119" can be chosen freely as appropriate.

The holding plates 119" exhibit advantage over the previously mentioned holding pins 119 in that they can bear substantially larger forces.

Figure 15:
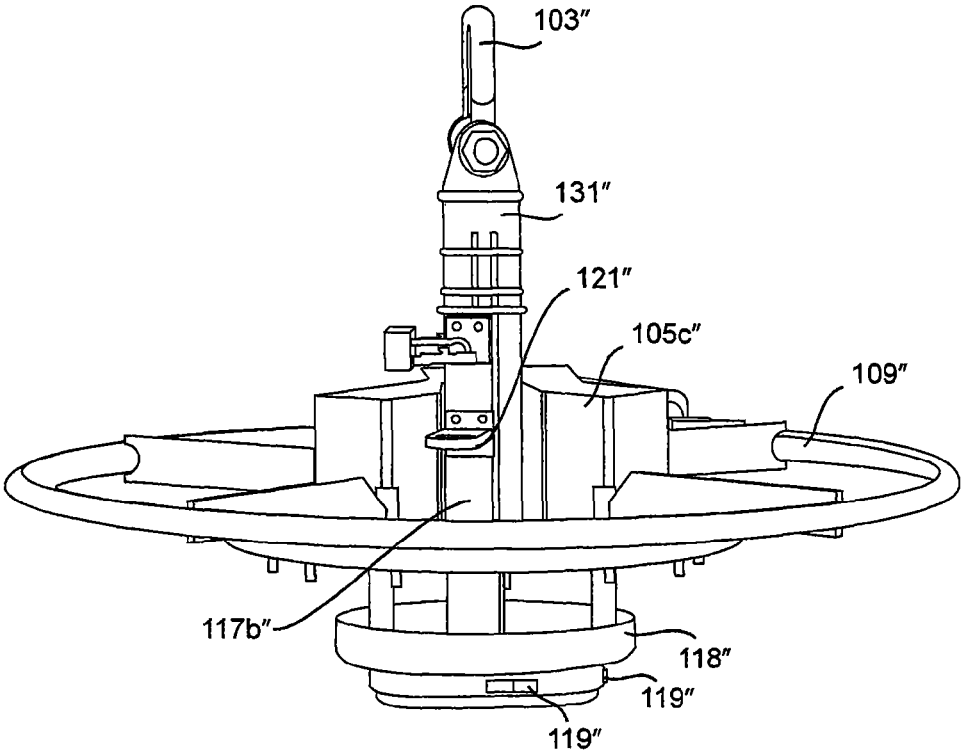
FIG. 15 is a perspective view of parts of the ITC running tool shown in FIG. 12 and FIG. 13.

FIG. 15 is a perspective view of parts of the running tool according to this embodiment. In this drawing, one can see part of the holding plates 119" extending out of the main body 118" of the holding element 117", as well as other previously described components.

Figure 16:
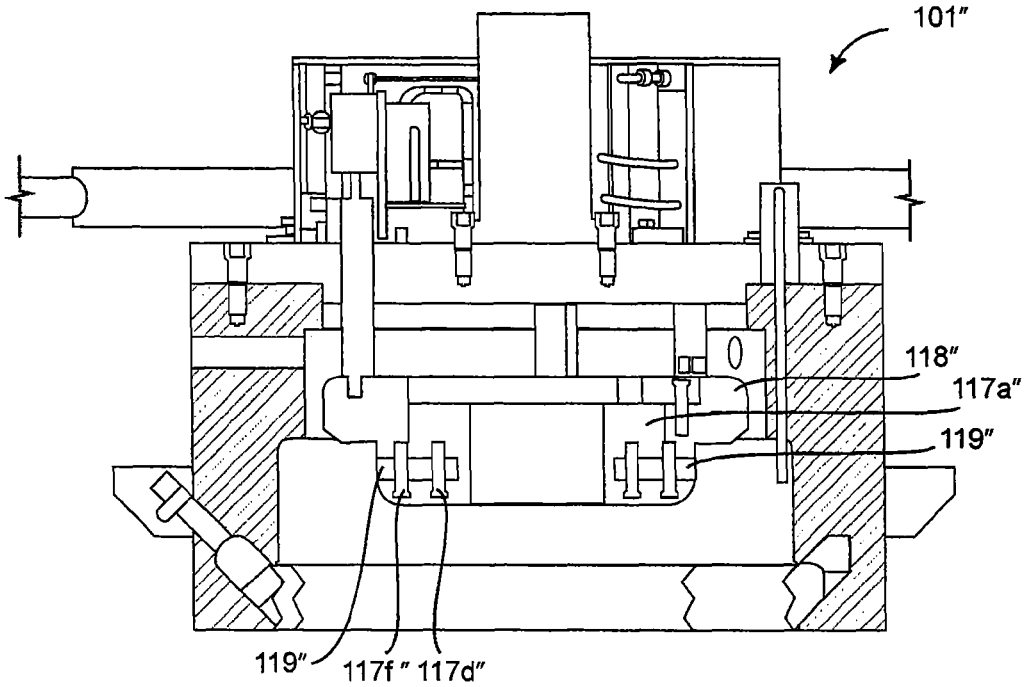
FIG. 16 is a cross section view of the alternative ITC holding element.

FIG. 16 is an enlarged cross section view of parts of the running tool 101", showing the holding element 117" from the side. In this representation, the holding plates 119" do not extend outside the perimeter mentioned above, and are thus in an "unlatched" position. The ITC is not shown.

Figure 17:
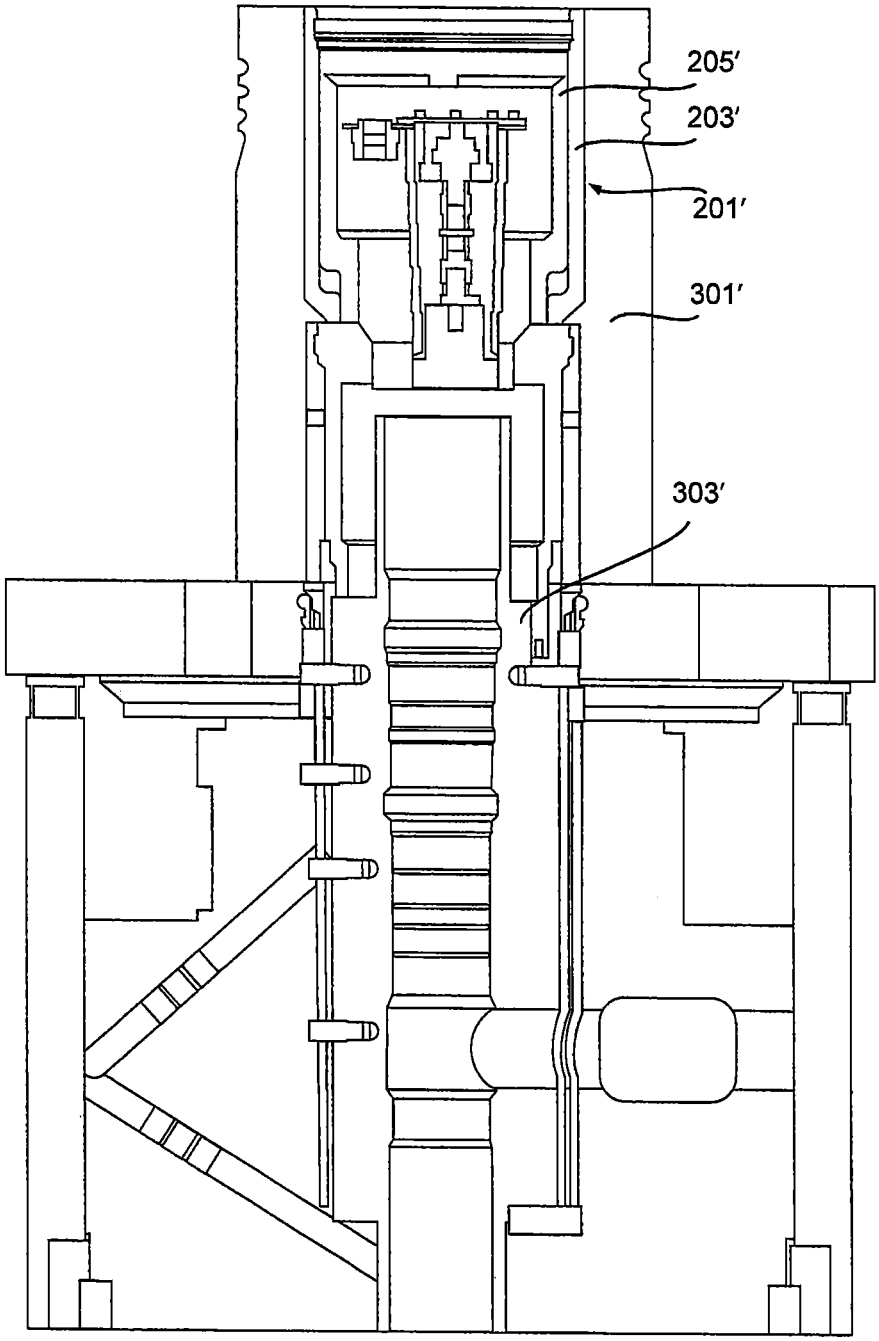
FIG. 17 is a cross section view of an ITC left in the tree spool, with the running tool retracted.
Figure 18:
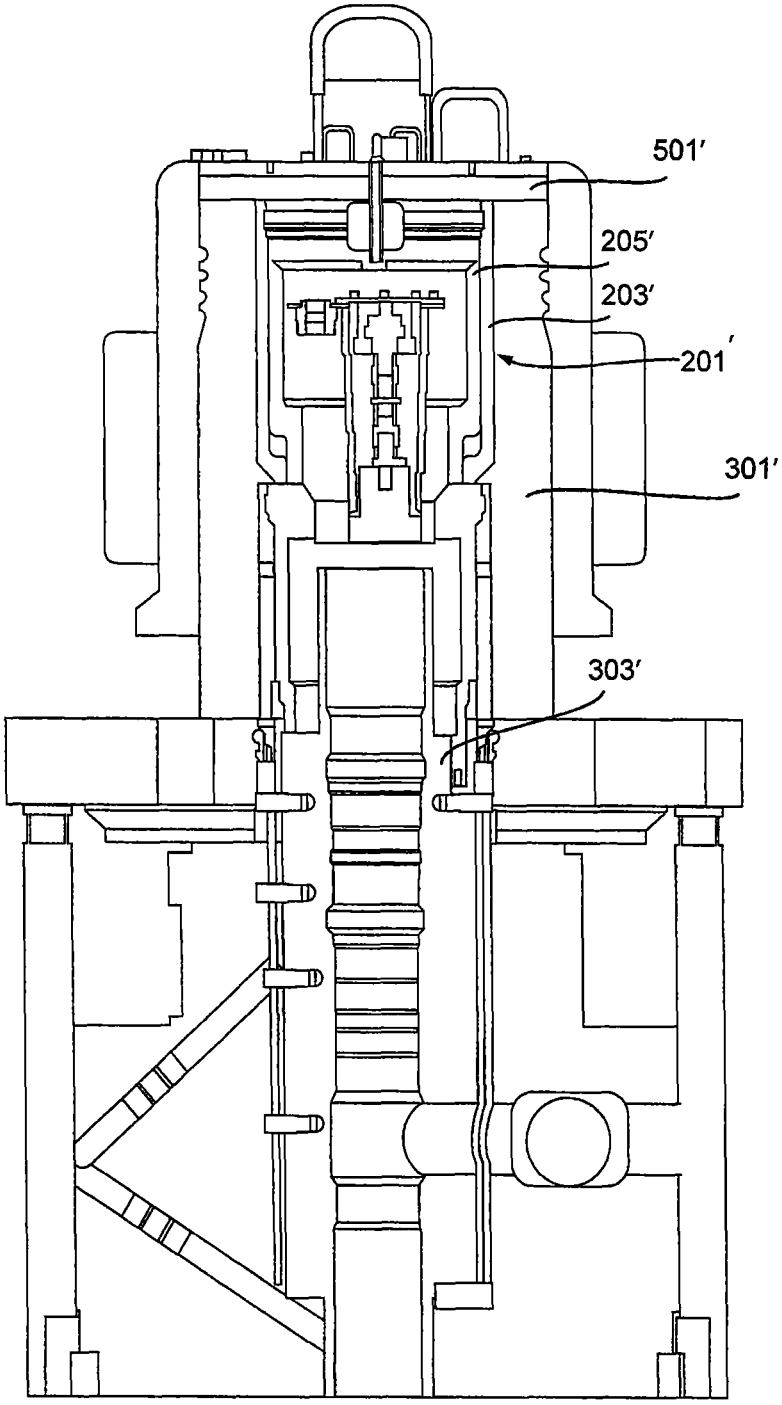
FIG. 18 is a cross section view of the ITC in FIG. 17, shown with a debris cap arranged on the tree spool.

FIG. 17 is a cross section view showing an ITC 201' left in the tree spool after being run with a running tool as described herein, for instance the running tool 101' shown in FIG. 12 and FIG. 13. FIG. 18 shows the same ITC 201' with a debris cap 501' arranged over it, for preventing debris falling into it from above.

The invention claimed is:

1. An internal tree cap installed in a bore of a subsea X-mas tree, comprising:

a locking element for releasably locking the internal tree cap to said bore;

a fluid channel extending through a fluid barrier between a lower part and an upper part of the internal tree cap;

wherein the fluid channel is blocked by a burst element adapted to break and open for fluid flow through the fluid channel when exposed to a predetermined pressure difference over the burst element; and a valve arranged in connection with a fluid passage in said fluid barrier between the upper and lower parts of the internal tree cap, the valve having an ROV (remotely operated vehicle) handling lever enabling an ROV to open and close the valve.

2. The internal tree cap according to claim 1, comprising a pipe in connection with and above the fluid channel, the pipe having a bend to prevent falling debris to block the fluid channel.

3. A method of retrieving an internal tree cap through a marine riser from a bore of a subsea well element, wherein a PTV-line (plug testing valve-line) is blocked resulting in a sealed off space between the internal tree cap and a lower barrier, the method comprising:

connecting an internal tree cap retrieving tool to the internal tree cap, wherein the internal tree cap comprises a locking element releasably locking the internal tree cap to a tubing hanger or a tree spool; a fluid channel extending through a fluid barrier of the internal tree cap between a lower part and an upper part of the internal tree cap; a burst element arranged in the fluid channel; and a valve connected in a fluid passage through the fluid barrier;

applying pressure in a riser of such magnitude that the burst element in the fluid channel between the space and the lower part of the internal tree cap bursts for opening the fluid channel; and pulling up the internal tree cap retrieving tool and disengaging the internal tree cap from engagement with the subsea well element.

4. The method according to claim 3, wherein the valve connected in the fluid passage comprises an ROV (remotely operated vehicle) handling flange for manually operating the valve between an open and close position via an ROV from above the internal tree cap.

5. A system, comprising:

an internal tree cap releasably locked in a tubing hanger that is arranged in a tree spool, the internal tree cap comprising:

an outer sleeve reciprocally arranged on an inner sleeve;

a locking element releasably locking the internal tree cap to the tubing hanger;

a fluid channel extending through the inner sleeve between a lower part and an upper part of the internal tree cap;

a burst element arranged in the fluid channel, the burst element adapted to break and open for fluid flow through the fluid channel when exposed to a predetermined pressure difference over the burst element; and a valve connected in a fluid passage through the inner sleeve between the upper and lower parts of the internal tree cap, the valve having an ROV (remotely operated vehicle) handling lever enabling an ROV to open and close the valve.

6. The system of claim 5, comprising a pipe in connection with and above the fluid channel, the pipe having a bend of about 180 degrees to prevent falling debris to block the fluid channel.

* * * * *